United States Patent [19]

Fischer et al.

[11] 4,332,846

[45] Jun. 1, 1982

[54] CAN COVER

[75] Inventors: Joseph Fischer, Cincinnati, Ohio; Gerald M. Platz, Conroe, Tex.

[73] Assignee: National Distillers & Chemical Corp., New York, N.Y.

[21] Appl. No.: 249,521

[22] Filed: Mar. 31, 1981

Related U.S. Application Data

[63] Continuation of Ser. No. 115,962, Jan. 28, 1980, abandoned.

[51] Int. Cl.[3] ..... B32B 3/10; B65D 17/32; B65D 17/34

[52] U.S. Cl. ..... 428/131; 220/260; 220/266; 220/268; 220/269; 220/270; 220/359; 222/482; 222/544; 428/42; 428/461; 428/520; 428/522

[58] Field of Search ..... 428/131, 42, 461, 520, 428/522; 220/268, 359, 260, 541, 266, 270, 269; 222/485, 482, 544

[56] References Cited

U.S. PATENT DOCUMENTS

| | | | |
|---|---|---|---|
| 2,776,787 | 1/1957 | Nicol | 220/359 X |
| 3,292,828 | 12/1966 | Stuart | 220/260 X |
| 3,883,034 | 5/1975 | Rausing | 220/268 |
| 3,889,844 | 6/1975 | Viker et al. | 220/359 |
| 3,908,857 | 9/1975 | Chiappe | 220/359 |
| 3,966,079 | 6/1976 | Kawamata | 220/359 X |

OTHER PUBLICATIONS

I. P. Esbit, Defensive Publication T927,011, 927 0G10.

*Primary Examiner*—Thomas J. Herbert, Jr.
*Attorney, Agent, or Firm*—Kenneth D. Tremain

[57] ABSTRACT

An improvement in can covers having a peelable closure member of the pull tab or tear strip type is provided wherein the closure member is fabricated from a partially hydrolyzed ethylene-vinyl acetate copolymer obtained from the hydrolysis of from about 50 percent to about 80 percent of the vinyl acetate groups of an ethylene-vinyl acetate copolymer containing from about 40 percent to about 80 percent by weight of interpolymerized vinyl acetate.

5 Claims, No Drawings

CAN COVER

This is a continuation of Ser. No. 115,962, filed Jan. 28, 1980, now abandoned.

BACKGROUND OF THE INVENTION

1. Field of the Invention

This invention relates to an aluminum can cover having an improved peelable closure member of the pull tab or tear strip type.

2. Description of the Prior Art

U.S. Pat. No. 2,776,787 describes a completely detachable closure tab for a container lid which is bonded to the lid employing unspecified pressure sensitive adhesives. The easy opening can of U.S. Pat. No. 3,292,828 possesses a lid which is sealed by a completely removable metal or plastic tape, or combination metal and plastic tape, bonded to the lid with a polyethylene-polyvinylacetate adhesive film. U.S. Pat. No. 3,389,827 describes an easy opening container in which the dispensing opening is sealed with a pressure-sensitive tape held in place with an adhesive such as cross-linked high molecular weight acrylate polymer, polychloroprene, trans-polyisoprene, homopolymer or copolymer of vinyl monomers such as vinyl arene, vinyl pyridine, vinyl halide and vinyl carboxylate, as well as acrylic monomers such as acrylonitrile, methacrylonitrile, and esters of acrylic acids. Defensive Publication No. T927,011 (927 O.G.10) discloses a hot melt adhesive for sealing the scribed portion of an easy opening lid containing, inter alia, an ethylene-vinyl acetate copolymer. U.S. Pat. No. 3,883,034 describes a can closure having a cover strip which can be peeled away to reveal an aperture with one end of the cover strip being permanently attached to the closure along sealing zones which are bonded to the closure with plastic or adhesive. The tape tabs of U.S. Pat. No. 3,889,844 are bonded to the lid of a container employing such adhesives as rubber-resin; a mixture of crude rubber smoked sheets, phenolformaldehyde resin, wood rosin and poly-beta-terpene; vinyl acetate:2-ethylehexyl acrylate:vinyl alcohol:acrylic acid polymer cross-linked with polycarbodiimide; vinyl acetate:ethyl acrylate:2-ethylhexyl acrylate:acrylic acid polymer crosslinked with p-toluene sulfonic acid-catalyzed melamine resin; iso-octyl acrylate:ethyl acrylate:acrylic acid polymer; polamide resin; polyester-polyurethane resin; and, polyester derived from the reaction of isophthalic acid, terephthalic acid and ethylene glycol. U.S. Pat. No. 3,908,857 describes a tape seal for the lid of a container, the tape seal being provided with a ring pull which is folded over the tape. The tape is secured to the lid by an adhesive, no specific types of which are given. U.S. Pat. No. 3,966,079 describes a sealing device which is removably attached to a container lid using an adhesive of unspecified type.

SUMMARY OF THE INVENTION

In accordance with the present invention, an apertured aluminum cover for a can is provided with a peelable closure member covering said aperture, the peelable closure member being fabricated from a partially hydrolyzed ethylene-vinyl acetate copolymer obtained from the hydrolysis of from about 50 percent to about 80 percent of the vinyl acetate groups of an ethylene-vinyl acetate copolymer containing from about 40 percent to about 80 percent by weight of interpolymerized vinyl acetate. When the aforesaid closure member is peeled away from the can cover to reveal the aperture, a portion of the closure member remains bonded to the lid. The partially hydrolyzed ethylene-vinyl acetate closure members of this invention provide an unusually tenacious bond with the aluminum can cover yet can be readily peeled back from the latter upon application of a force applied with an average degree of exertion. Since partially hydrolyzed ethylene-vinyl acetate copolymers are acceptable for food packaging use, they are for this reason additionally superior to other adhesive materials which do not possess this status. The superior bonding properties of partially hydrolyzed ethylene-vinyl acetate copolymer not only insures the integrity of the seal but permits a portion of the copolymer to remain attached to the can cover so as not to become a potential or actual source of litter.

DESCRIPTION OF THE PREFERRED EMBODIMENTS

In general, any apertured aluminum can cover heretofore in use can with little or no modification be employed herein. The aperture or apertures can be of any configuration, e.g., triangular, circular, etc., and can be defined upon a cover of any suitable thickness, e.g., from about 10 mils to about 50 mils. The closure member too, can be of any suitable configuration and thickness provided it is sufficient to completely occlude the aperture and retain the integrity of the seal therewith. For most applications, a closure member thickness of from about 2 mils to about 20 mils is entirely satisfactory. If desired, the closure member herein can be backed with a metal or plastic foil or a combination thereof. In addition, the closure member can be provided with means for facilitating its removal from the can cover, e.g., a pull ring.

The partially saponified ethylene-vinyl acetate copolymers which are useful herein are obtained from the hydrolysis of from about 50 percent to about 80 percent, and preferably from about 60 percent to about 75 percent, of the vinyl acetate groups of an ethylene-vinyl acetate copolymer containing from about 40 percent to about 80 percent by weight, and preferably from about 50 to about 70 percent by weight, of interpolymerized vinyl acetate. Any of the methods of hydrolyzing ethylene-vinyl acetate copolymer heretofore disclosed can be used in the preparation of the partially hydrolyzed ethylene-vinyl acetate copolymer bonding agents herein. Usually, the hydrolysis of ethylene-vinyl acetate copolymer is accomplished by the process of alcohoysis or transesterification in an alcoholic medium in the presence of an acid or basic catalyst. Hydrolysis can be accomplished in solution, in the swollen solid phase or by saponification.

By way of demonstrating the superior bond strength provided by the partially hydrolyzed ethylene-vinyl acetate copolymer closure members herein, comparison was made between the bond strengths of various fully hydrolyzed copolymers of ethylene and vinyl acetate applied as strips to an aluminum foil of 5 mils thickness and the bond strengths of various partially hydrolyzed copolymers of ethylene and vinyl acetate applied as identically shaped strips to a specimen of the same aluminum foil. The results were as follows:

| I. T-Peel Adhesion of Substantially Fully Hydrolyzed Ethylene-Vinyl Acetate Copolymers | |
|---|---|
| Original Weight Percent of Interpolymerized Vinyl Acetate | Bond Strength (pounds per linear inch of width) |
| 26 | 0.6 |
| 30 | 1.4 |
| 40 | 2.6 |
| 50 | 7.8 |

| II. T-Peel Adhesion of Partially Hydrolyzed Ethylene-Vinyl Acetate Copolymer Containing About 12–13 Weight Percent Residual Interpolymerized Vinyl Acetate. | |
|---|---|
| Original Weight Percent of Interpolymerized Vinyl Acetate | Bond Strength (pounds per linear inch of width) |
| 30 | 11.8 |
| 40 | 18.8 |
| 50 | 23.9 |

As the above data show, a very substantial increase in bond strength is observed with closure member strips fabricated with partially hydrolyzed ethylene-vinyl acetate copolymer prepared from a copolymer of at least 40 weight percent interpolymerized vinyl acetate content.

What is claimed is:

1. In an apertured aluminum can cover having a peelable closure member of the pull tab or tear strip type covering said aperture, such that when the aforesaid closure member is peeled away from the can cover to reveal the aperture, a portion of the closure member remains bonded to the can cover, the improvement which comprises a closure member directly adhered to the can cover, said closure member fabricated from a partially hydrolyzed ethylene-vinyl acetate copolymer obtained from the hydrolysis of from about 50 percent to about 80 percent of the vinyl acetate groups of an ethylene-vinyl acetate copolymer containing from about 40 percent to about 80 percent by weight of interpolymerized vinyl acetate.

2. The can cover of claim 1 wherein the partially hydrolyzed ethylene-vinyl acetate copolymer constituting the closure member is backed with, and directly adhered to, a metal or plastic foil.

3. The can cover of claim 1 wherein the partially hydrolyzed ethylene-vinyl ester is obtained from the hydrolysis of from about 60 percent to about 75 percent of the vinyl acetate groups of an ethylene-vinyl acetate copolymer containing from about 50 percent to about 70 percent by weight of interpolymerized vinyl acetate.

4. The can cover of claim 1 wherein the strength of the bond between the can cover and the peelable closure member is at least about 15 pounds per linear inch of width of the peelable closure member.

5. The can cover of claim 4 wherein the strength of the bond between the can cover and the peelable closure member is at least about 20 pounds per linear inch of width of the peelable closure member.

* * * * *